US005391017A

United States Patent [19]

Thomas et al.

[11] Patent Number: 5,391,017

[45] Date of Patent: Feb. 21, 1995

[54] CONTINUOUS MOVING DEPRESSION CUTTING TOOL FOR HIGHWAY USE

[76] Inventors: Glen E. Thomas; Amona D. Thomas, both of P.O. Box 1083, Moore Haven, Fla. 33471

[21] Appl. No.: 118,961

[22] Filed: Sep. 10, 1993

[51] Int. Cl.[6] ..... E01C 23/09

[52] U.S. Cl. ..... 404/90; 404/72; 404/93; 404/94; 299/38; 299/39

[58] Field of Search ..... 404/72, 90, 93, 94; 299/38, 39

[56] References Cited

U.S. PATENT DOCUMENTS

| | | | |
|---|---|---|---|
| 3,094,047 | 6/1963 | Patton | 404/94 |
| 3,807,634 | 4/1974 | Vogt | 239/150 |
| 4,701,069 | 10/1987 | Whitney | 404/75 |
| 4,744,604 | 5/1988 | Lewis et al. | 299/10 |
| 4,797,025 | 1/1989 | Kennedy | 404/90 |
| 4,824,516 | 4/1989 | Ishihara et al. | 156/523 |
| 4,896,995 | 1/1990 | Simmons | 404/90 |
| 4,900,094 | 2/1990 | Sergeant | 299/39 |
| 4,938,537 | 7/1990 | Rife, Jr. et al. | 299/39 |
| 4,943,199 | 7/1990 | Hillen | 414/331 |
| 4,986,604 | 1/1991 | Meister | 299/39 |
| 5,046,890 | 10/1991 | Dickson | 404/90 |
| 5,059,061 | 10/1991 | Stenemann et al. | 404/72 |
| 5,094,565 | 3/1992 | Johnson | 404/75 |
| 5,161,910 | 10/1992 | O'Konek | 404/90 |
| 5,297,894 | 3/1994 | Yenick | 404/90 |

*Primary Examiner*—Ramon S. Britts

*Assistant Examiner*—Pamela O'Connor

*Attorney, Agent, or Firm*—Quarles & Brady

[57] ABSTRACT

A machine that cuts sonic noise alert pattern (SNAP) depressions into the upper surface of asphalt highways. This machine is designed to cut depressions having a rectangular shape, with opposing transitional edges, which are relatively perpendicular to the edge of the road surface, and each have a smooth, even transition from the road surface to the cut depression. Further having a predetermined, but variable, depth along the center of the depression cut, with this center of the cut located at a relatively midpoint between the transitional edges. Additionally having an uniform section of virgin, uncut, asphalt located between each set of adjacent depression cuts. The machine, which has at least one rotating cutting head, moves longitudinally, relative to the desired placement of the individual cuts, in a non-stop, uninterrupted manner. The use of an eccentric wheel or eccentric cam provides for the pivotal raising and lowering of the cutting head and further provides for the spacing of the individual cuts as well as their width and depth. The provision is made for use of a round wheel, with the pivotal axle offset from its center, or for the use of wheels of oval or elongated designs. Provision is made for having a machine, such as a skid steer loader, pull or push the cutting head assembly or to have a custom built unit, having no other function than the cutting of SNAP depressions.

15 Claims, 3 Drawing Sheets

CONTINUOUS MOVING DEPRESSION CUTTING TOOL FOR HIGHWAY USE

BACKGROUND OF THE INVENTION

1. Field of the Invention

This invention relates to a device that cuts a series of depressions into the upper surface of asphalt. A method is utilized that allows the machine to make such individual cuts without requiring stopping or pausing the forward motion of the machine. Further it relates to the method utilized to provide for the repetition of lowering and raising the cutting head. This repetition results in uniformity of placement and sizing of the individual cuts, during the cutting procedure. This method involves the use of an eccentric wheel assemble, which would partially support the cutting head assemble. This eccentric wheel assembly, having its pivotal shaft offset from the wheels actual center, produces an eccentric roll. This eccentric roll acts to raise and lower the pivotal shaft with a corresponding raising and lowering of the attached cutting head assemble. The cutting head assembly would have its opposing end secured to a pivotal point being at least one other eccentric wheel, the axle of at least one support wheel or at least one skid with this assembly being in constant contact with the road surface under treatment. Thus the cutting head assembly would pivot up and down from this assembly.

2. Brief Description of the Prior Art

Sonic noise alert pattern (SNAP) are a series of cuts in the surface of asphalt which have the purpose of providing vibration, and therefore noise, when the tires of a vehicle travel longitudinally along them.

These depressions are utilized by road departments as a safety device. Generally they are placed along the opposing edges of a highway to act to alert a driver that his vehicle has extended beyond the normal driving surface. Additionally they can be placed along the line which divides traffic flowing in one direction from traffic flowing in the opposing direction, commonly referred to as the center line. Beyond the normal driving surface, many dangerous conditions exist for a vehicle traveling at the posted speed limit. These dangers include dirt or gravel shoulders, guardrail barriers, signs, mailboxes, intersecting roadways or driveways, disabled vehicles and others.

SNAP's are a relatively recent addition to the various safety features that highway departments are utilizing to reduce property damage, bodily injury and death from accidents on our roads. The various specifications for the placement and physical dimensions can vary widely from state to state and even within a particular state. A common size and placement, used only for illustration and not limitation, has the cuts placed apart twelve inches from center of one cut to center of the next cut, with a measurement of the actual cut being seven inches from back edge of cut to front edge of cut, a depth at the deepest point of one half an inch and a length, from the side toward the edge of road to the side toward the center of the road, of sixteen inches. This specification results in five inches of uncut surface between each set of adjacent depressions. Therefore, the above specifications would require fifty-two hundred and eighty cuts per mile. Rural roads are the most likely location for SNAP depressions to be installed due to the fatigue that drivers experience during extended driving on such roads.

In the art we find attempts to provide a mechanical device capable of economically cutting such depressions into the exposed surface of asphalt roadways. Your applicant is aware of only one machine capable of cutting the depressions described above. This machine is a cutting tool, using a rotating milling head, having a plurality of cutting teeth. The size of the cutting head required for a plunge cut matching the above specifications is approximately twenty-four inches in diameter and sixteen inches wide. This size cutting head can make a single plunge cut that is seven inches from front to back, one half an inch deep and sixteen inches wide.

U.S. Pat. No. 5,094,565, issued on Mar. 10, 1992 to Henry M. Johnson based on a filing date of Dec. 4, 1990, discloses a multi-headed cutting tool. All current use machines utilize the plunge cut where the cutting head is held aloft from the surface of the highway and the machine is carefully positioned corresponding to the desired location of cut. Then, with the machine standing at a complete stop, the head is mechanically lowered to the surface and cutting begins. The cutting action then continues to the desired depth, generally about one half an inch at the center, or deepest point. The cutting head is then mechanically raised and the entire machine is advanced to the next desired location. A single headed machine is advanced longitudinally by the distance of the desired spacing of the cuts, for the above description, one foot. At this time the machine is brought to a complete standstill and the lowering and raising procedures are repeated. This results in the requirement of advancing and stopping fifty-two hundred and eighty times per mile of work completed. Additionally, the resulting cuts are not as uniformly placed nor as uniformly spaced as desired due to the limitations of the operator in the precision placement of the machine. Johnson's multi-headed cutting tool allows for multiple cuts to be made with each repetition. With a four headed machine as disclosed, thirteen hundred and twenty repetitions are required per mile and operator precision placement is still required.

Your applicant is unaware of any current use of a cutting tool which is capable of facilitating cutting such depression, based on industry standards for size and placement, in a continuous manner, without requiring stopping the machine prior to each individual cut, or set of cuts, being made. Nor of a method of ensuring uniformity, among the individual cuts within a series, in their size and relative placement.

OBJECTS AND ADVANTAGES OF THE INVENTION

The primary object of this invention is to provide for an economical method of cutting SNAP type depression in the exposed surface of asphalt of highways. Other objects include;

(a) provide for the cutting of such depressions without necessitating stopping the machine during the cutting operation.

(b) provide an eccentric wheel assembly, having a perfectly round wheel and a pivotal shaft which is offset from the wheel's actual center, to allow for an eccentric roll of the wheel.

(c) provide a wheel assembly, having an oval or elongated wheel and a pivotal shaft which is offset from the wheels actual center, to allow for an eccentric roll of the wheel.

(d) provide for the partial support of the cutting head assembly by the pivotal shaft thus allow for the raising and lower of the cutting head assembly during the eccentric rolling of the wheel assembly.

(e) provide for an assembly, either a wheel attached to the cutting head assembly, or incorporated into the self propelled vehicle, which would regulate the rotation of a cam. This cam would thus revolve in a synchronized manner to the passage of the machine over the road surface under treatment. The revolution of this cam would facilitate the lowering and raising of the cutting head assembly, which would result in the cutting of the desired series of depressions.

(f) provide for the optional covering of the exterior of the wheel assembly with a substance which will not slip on asphalt such as rubber or some other synthetic material.

(g) providing for the uniformity of the dimensions of the individual cuts within a series of cuts.

(h) provide for the uniformity of the spacing of the individual cuts, measured from the centers of adjacent cuts, within a series of depression cuts.

(i) provide for the ability to adjust the machine to allow for different specifications of SNAP depression cuts. These adjustments involve the depth of cut, the length of cut, from front tapered edge to back tapered edge, the spacing, measured from centers of each set of adjacent cuts, and the distance between each set of adjacent cuts, of the uncut asphalt. These adjustments involve providing various diameter sizes of wheel assemblies, each having a circumference equal to the desired spacing of adjacent cuts, and providing for the adjustment of the height of the cutting head relative to the pivotal shaft of the eccentric wheel.

(j) provide for the cutting operation to be performed by pushing the cutting head apparatus utilizing a self propelled vehicle such as a skid steer loader.

(k) provide for the cutting operation to be performed by pulling the cutting head apparatus utilizing a self propelled vehicle such as a skid steer loader.

(l) provide for the cutting operation to be performed utilizing a self propelled vehicle having the cutting head apparatus permanently incorporated into the machine.

Other objects, advantages and features of the present invention will become apparent to those skilled in the art from the detailed description which follows. It should be understood, however, that the detailed description and specific examples, while indicating preferred embodiment, are given as examples and not limitations. Many changes and modifications to the invention are possible without departing from the spirit of the invention, and all such modifications are included. Thus the scope of the invention should be determined by the appended claims rather than the specific embodiments shown.

BRIEF DESCRIPTION OF THE DRAWINGS

FIG. 5 is a side plan view of a simplified illustration of a cutting head assembly.

FIG. 6 is a side plan view of a simplified illustration of a cutting head assembly.

FIG. 7 is a side plan view of a simplified illustration of a cutting head assembly.

FIG. 8 is a side plan view of a simplified illustration of a cutting head

FIG. 9 is a side plan view of a simplified illustration of a cutting head assembly.

Figure 1:
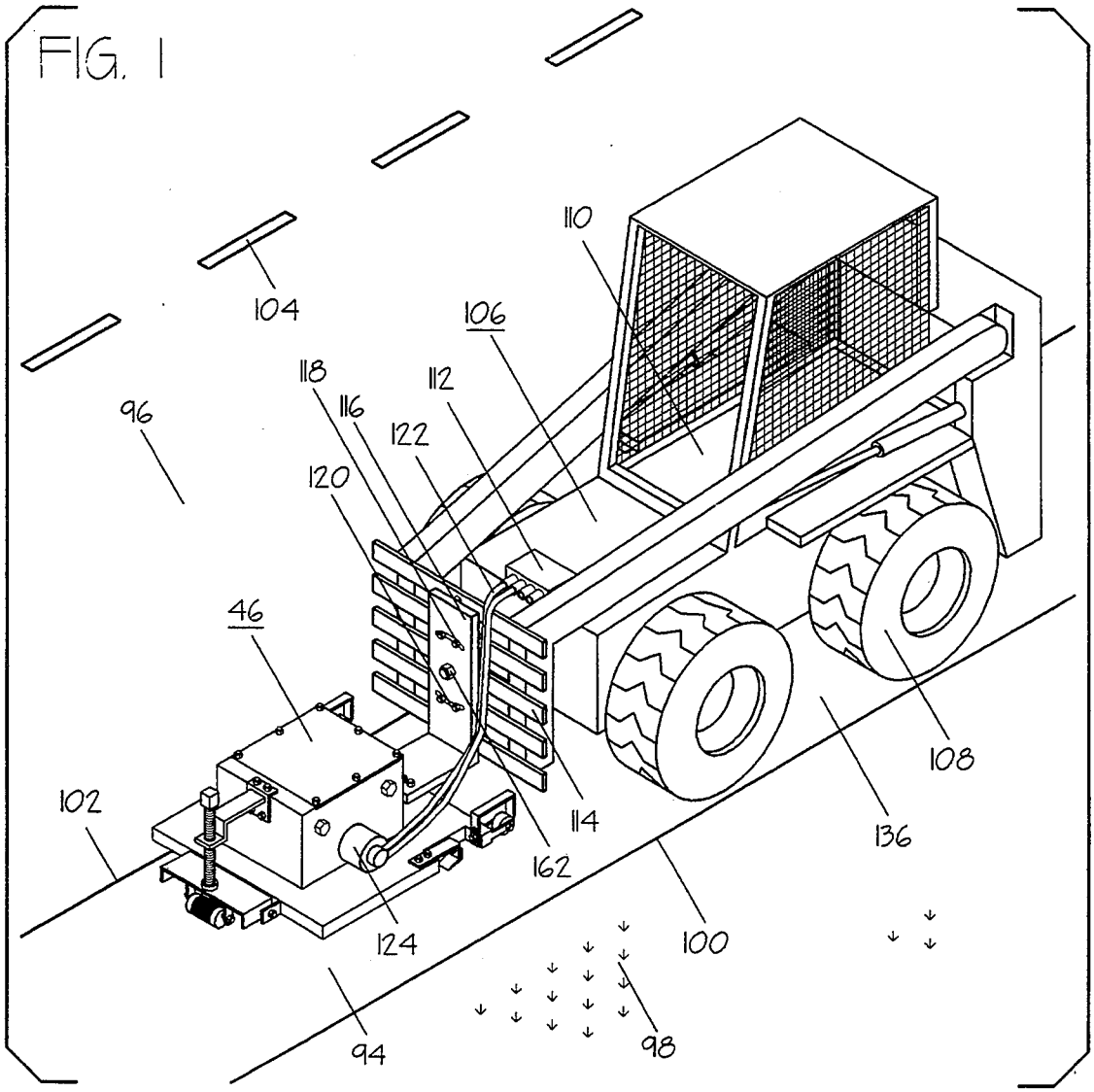
FIG. 1 is a bracketed perspective view of a skid steer loader with a cutting head assembly attached, as it sits on the side of a road.

| | |
|---|---|
| 10. Wheel | 12. Wheel shaft |
| 14. Contact surface | 16. Traction enhancement units |
| 18. Connector | 20. Wheel support plate |
| 22. Support member | 24. Wheel assembly |
| 26. Adjustment shaft | 28. Abutting member |
| 30. Nut | 32. Connection member |
| 34. Assembly support plate | 36. Shaft penetration plate |
| 38. Attachment plate | 40. Adjustment support |
| 42. Attachment nut | 44. Attachment bolt |
| 46. Cutting head assembly | 48. Cutting head enclosure |
| 50. Entry plate | 52. Entry plate bolt |
| 54. Entry plate nut | 56. Cutting head adjustment apparatus |
| 58. Rotation generation device | 60. Adjustment connector |
| 62. First support wheel | 64. Second support wheel |
| 66. Wheel cleaning member | 68. Road clearing member |
| 70. Connection member | 72. Connection bolt |
| 74. Variable attachment member | 76. Connecting bolt |
| 78. Assembly attachment hole | 80. Cut depression |
| 82. First edge | 84. Second edge |
| 86. First side | 88. Second side |
| 90. Center of cut | 92. Separating strip |
| 94. Extended edge | 96. Driving surface |
| 98. Shoulder | 100. Edge of pavement |
| 102. Side marking line | 104. Center marking |
| 106. Skid steer loader | 108. Wheel |
| 110. Operator compartment | 112. Hydraulic coupling |
| 114. Connecting plate | 116. Attachment plate |
| 118. Bolt | 120. Slot |
| 122. Hydraulic hose | 124. Hydraulic connection |
| 126. Locking hole | 128. Recessed surface |
| 130. Bolt | 132. Shaft |
| 134. Nut | 136. Asphalt |
| 138. Eccentric wheel | 140. Cutting drum |
| 142. Cutting teeth | 144. Drum housing |
| 146. Support wheel | 148. Cutting head platform |
| 150. Cut depression | 152. Center of depression |
| 154. Track of drum center | 156. Eccentric wheel axle |
| 158. Wheel axle | 160. Separating strip |
| 162. Bolt | |

SUMMARY OF THE INVENTION

A device that will cut a series of SNAP depressions, each depression having the desired width, depth and placement within the series, without requiring pausing the machine during the cutting of the series of depressions. The machine moves in a continuous and relatively even pace along the line of the desired series. During this fluid motion of the machine, the cutting head, comprised of a rotating milling head, is raised and lowered automatically by an action regulated by the movement of the machine. This will either be accomplished by the use of an eccentric wheel or by an eccentric cam which is regulated so as to correspond to the movement of the machine. This eccentric wheel is either round with the pivotal center offset from the wheels actual center, or is oval or elongated in shape. The eccentric wheel is in continual contact with the surface of the highway during operation of the machine. The spacing of each set of adjacent cuts, measured from center to center, is equal to the circumference of the eccentric wheel. The axle of the eccentric wheel is partially supporting the cutting head assembly that houses the drum type cutting head. It being understood that the cutting head assembly that holds the cutting head is pivotally connected to at least one other point, being at least one other eccentric wheel, at lest one support wheel or at least one skid. This other connection apparatus is in contact with, and tracks, the surface of the road under treatment. Further it is understood that the cutting head pivots up and down slightly at this point during operation. The motion of the entire machine causes the eccentric wheel to turn relative to the road surface that it is rolling over. During this rolling action the pivotal shaft, which is not a uniform distance from all of the contact points on the eccentric wheel, is moving up and down relative to the surface of the road. It additionally is moving along the road surface in the direction of travel of the machine. When the pivotal shaft reaches its highest point relative to the road surface, the cutting head has pivoted up and is not in contact with the road surface. During the pivotal shafts decent to its closest point of contact with the road surface, the cutting head makes contact with the road surface, and cutting begins. When the pivotal shaft is at its lowest point, relative to the surface of the road, the cutting head is at the deepest part of the cut. Then the pivotal shaft begins its upward travel, relative to the surface of the road, and at some point during this travel the cutting head disengages from the surface of the road and the cutting action stops. As the machine moves, unstopped, along the road the prior steps are repeated to form a series of SNAP depression cuts as the cutting head pivots down and into contact with the surface and pivots up and out of contact with the surface.

In the use of a cam, the cam turns in a manner corresponding to the movement of the machine over the surface of the pavement under treatment. This results in the cam causing the cutting head assemble to be pull upward vertically and allowed to be pulled downward by its own weight. This facilitates the action of engaging and cutting the surface and disengaging and terminating cutting of the surface in the desired repetition. It being understood that many uses of eccentric wheels or cams is envisioned as being possible and are disclosed.

DESCRIPTION OF THE PREFERRED EMBODIMENT

Referring now to the drawings where like reference numerals refer to like parts throughout the various views. FIG. 1 is a bracketed perspective view of a skid steer loader 106 having an operator compartment 110 and a plurality of wheels 108. Shown is asphalt 136 which is comprised of a driving surface 96 and an extended edge 94 and being bordered by an edge of pavement 100. Adjacent to asphalt 136 is a shoulder 98 comprised of dirt and grass and having the characteristic of being unsuitable for high speed driving. Asphalt 136 has various markings in the form of a side marking line 102 which acts to separate driving surface 96 from extended edge 94 and further having a plurality of center markings 104 which act to separate the various lanes of traffic. Extended edge 94 is an area of pavement which provides drivers with additional safety by allowing them to leave the normal driving surface 96 without immediately driving onto shoulder 98 which is problematic at speeds above approximately fifteen miles per hour.

Skid steer loader 106 further having a hydraulic coupling 112 which has connected two hydraulic hoses 122 which are capable of providing hydraulic power. A plurality of connecting plates 114 are securely connected to skid steer loader 106 and have attached thereto utilizing bolt 162 and bolts 118, an attachment plate 116 having slots 120. It being understood that slots 120 and bolts 118 allow for slight movement of attachment plate 116 relative to connecting plates 114. This slight movement permits the attached cutting head assembly 46 to properly align, with all contact points in contact, with asphalt 136. Attached to attachment plate 116 is a cutting head assembly 46 having a hydraulic connection 124 which is supplied with hydraulic power by hydraulic hoses 122. It being understood that cutting head assembly 46 contains a drum type rotating cutting head which receives hydraulic power from skid steer loader 106. It is further understood that skid steer loader 106 provides motion to cutting head assembly 46 under the control of its operator.

Figure 2:
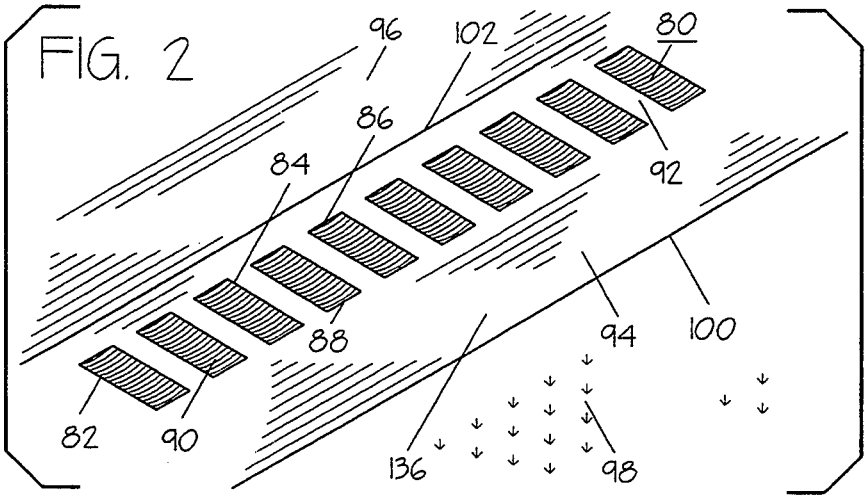
FIG. 2 is a bracketed perspective view of a side of a road having a series of cut depressions installed.

FIG. 2 is a bracketed perspective view of part of the asphalt 136 as illustrated in FIG. 1. Shown is asphalt 136 having an extended edge 94 and a driving surface 96 separated one from the other by a side marking line 102. Additionally asphalt 136 has an edge of pavement 1 00 beyond which is a shoulder 98. Extended surface 94 has installed, utilizing the cutting device illustrated in FIG. 1, a series of cut depressions 80. It being understood that the series of arcs shown extending across each depression 80 are shade lines intended to emphasize the shape of the resulting cuts. Each cut depression 80 has a first edge 82 and a second edge 84, which both are transitional edges, being tapered. Each further having a first side 86 and a second side 88, which each terminate in a respective end of first edge 82 and second edge 84. Each additionally having a center of cut 90 being generally the deepest part of cut depression 80 when measured from the prevailing surface of asphalt 136. Each set of adjacent cut depressions 80 is divided by a separating strip 92 being uncut asphalt 136. Due to the versatility of the device it may be utilized for widely varying specifications of SNAP's. For illustrative purposes only, the measurements of the cut depressions 80 as illustrated are sixteen inches wide from first side 86 to second side 88, seven inches across from first edge 82 to second edge 84, approximately one half of an inch deep measured at center of cut 90, with five inches between each respective set as measured by separating strip 92. Therefore the series of depressions are spaced twelve inches apart measured from one center of cut 90 on one cut depression 80 to center of cut 90 on an adjacent cut depression 80.

Figure 3:
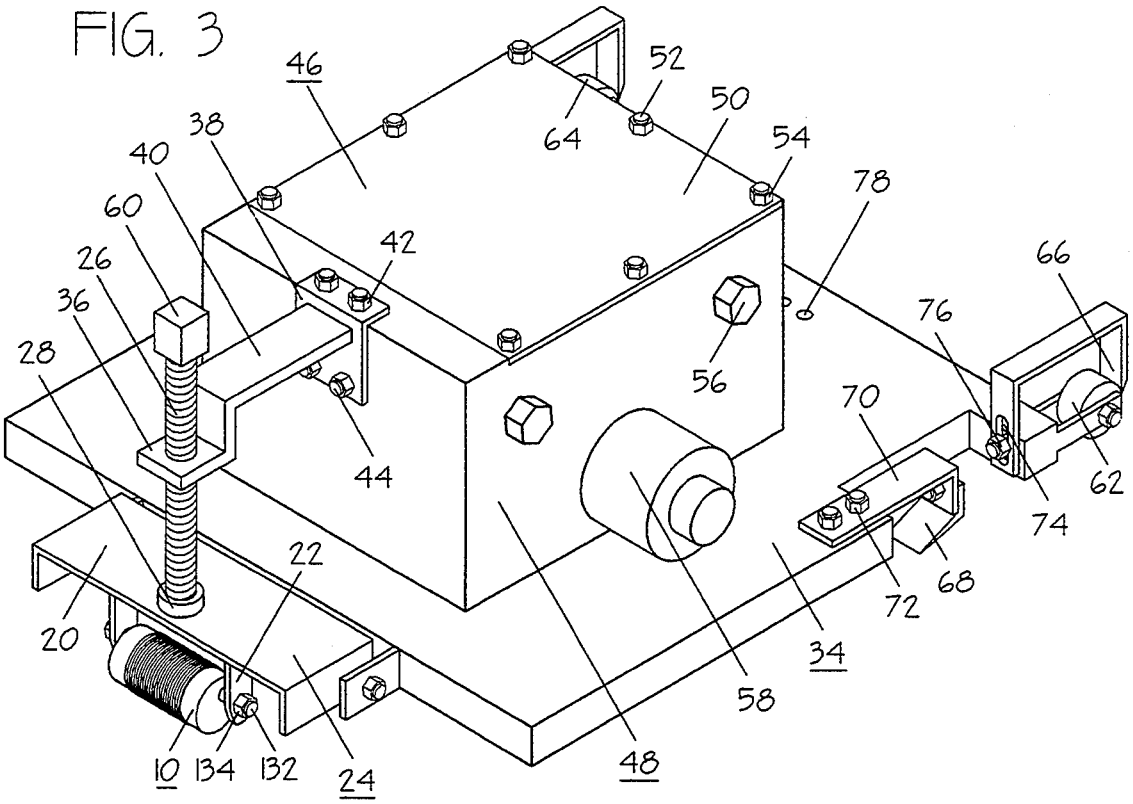
FIG. 3 is an enlarged perspective view of the cutting head assembly illustrated in FIG. 1.

FIG. 3 is an enlarged perspective view of a cutting head assembly 46 as illustrated in FIG. 1 and having a cutting head enclosure 48 and an assembly support plate 34. Cutting head enclosure 48, having an entry plate 50 attached thereto utilizing a plurality of entry plate bolts 52 with corresponding entry plate nuts 54. It being understood that a rotation type cutting head assembly is contained within cutting head assembly 46. It is further understood that while a cutting head with a diameter of approximately twenty-four inches is required for a plunge cut matching the example specifications given, a cutting head with various possible diameters, is possible for a machine utilizing our invention. A cutting head having a diameter of approximately twelve inches is shown and disclosed in FIGS. 5 through 9. Adjustment of the vertical position of this cutting head is facilitated by engaging cutting head adjustment apparatus 56 which provide for the secure placement and alignment of the cutting head relative to assembly support plate 34. Cutting head enclosure 48 is securely attached to an assembly support plate 34. Securely attached to assembly support plate 34 at opposing rear corners are first support wheel 62 and second support wheel 64 having the purpose of permitting the rolling of cutting head assembly 46 during use. It being understood that skids are envisioned as being applicable as substitutes to the disclosed support wheel members. Attached to each support wheel 62 and 64, is a wheel cleaning member 66 having the purpose of preventing attachment of any debris to the wheel that would prevent contact with the true surface of the asphalt pavement under treatment. Wheel cleaning member 66 is attached to assembly support plate 34 at variable attachment member 74 utilizing a connecting bolt 76. It being understood that each wheel cleaning member 66 would be adjustable, using variable attachment member 74, to its respective support wheel 62 or 64. Attached to assembly support plate 34 are opposing road clearing members 68 which would be pushed or dragged along the asphalt surface of the road directly in front of its respective support wheel 62 or 64 to clear a path and ensure that support wheel 62 or 64 was in contact with the true surface of the road under treatment. Attaching road clearing member 68 to assembly support plate 34 is a connection member 70 using connection bolt 72. Assembly support plate 34 additionally has a plurality of assembly attachment holes 78 which permit attachment to the equipment which provide transport and drive power to the cutting head. A rotation generation device 58 is provided to receive hydraulic power to drive the cutting head. It being understood that belt drive or chain drive power generation devices are applicable, envisioned and disclosed. Attached to cutting head enclosure 48 is an attachment plate 38 using a plurality of attachment bolts 44 and a plurality of attachment nuts 42. Attached to attachment plate 38 is an adjustment support 40 having a shaft penetration plate 36 attached thereto. Penetrating shaft penetration plate 36 is an adjustment shaft 26 having an adjustment connector 60 attached to its upper end and an abutting member 28 attached to its lower end. Connected pivotally to assembly support plate 34 is a wheel assembly 24 having a wheel support plate 20 which is in contact with abutting member 28. Connected to wheel support plate 20 are two support members 22 which support a wheel 10 which is eccentrically penetrated by shaft 132 and secured by opposing nuts 134. It being understood that wheel 10, being eccentrically penetrated by shaft 132, will roll in such a manner that shaft 132 will be forced up and down in repetitive strokes.

Figure 4:
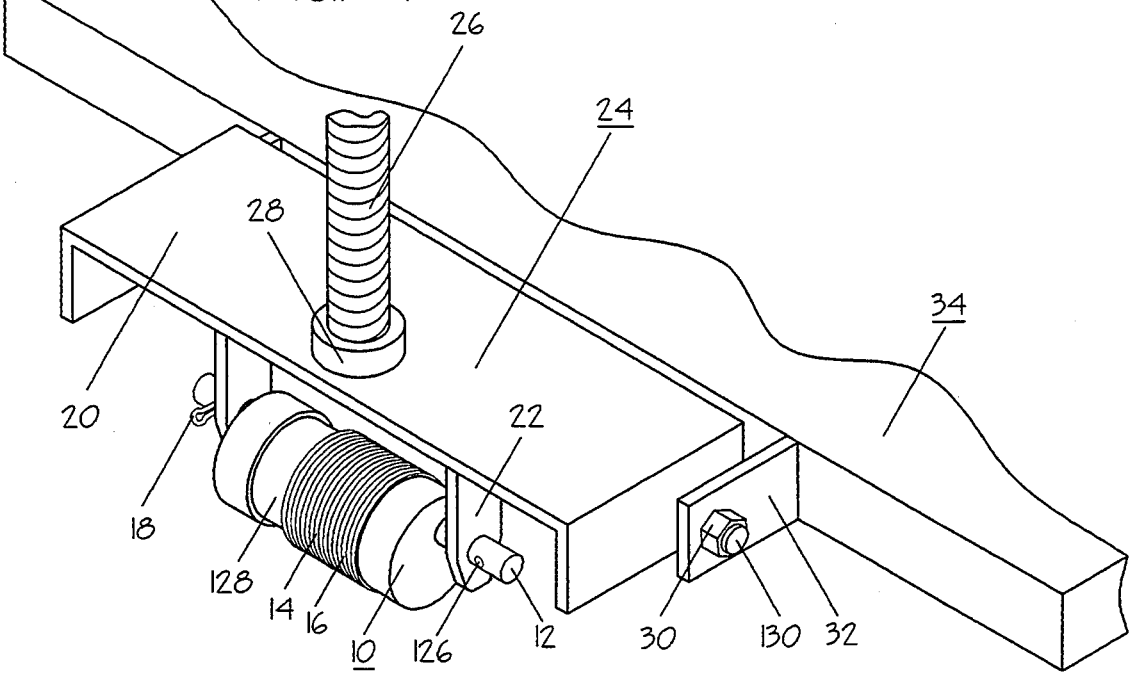
FIG. 4 is an enlarged perspective view of the cutaway front of the cutting head assembly illustrated in FIG. 3 with a second embodiment of the attachment of the eccentric wheel.

FIG. 4 is an enlarged perspective view of the front of the cutting head assembly 46 illustrated in FIG. 3 with a second embodiment of wheel connection attached. Shown is a cutaway section of assembly support plate 34 having two connection members 32 attached thereto. Attached to connection members 32, utilizing bolts 130 and nuts 30 is a wheel assembly 24 having a wheel support plate 20. In contact with the upper surface of wheel support plate 20, is adjustment shaft 26 having an abutting member 28. Extending from wheel support plate 20 are two support members 22 which secure a wheel shaft 12 having opposing locking holes 126, utilizing connectors 18. Wheel shaft 12 eccentrically penetrates wheel 10 and secures it thereto. Wheel 10 having a recessed surface 128 has a series of traction enhancement units 16 secured thereto forming a contact surface 14 having the purpose of ensuring proper traction with the surface of the asphalt road upon which treatment is being undertaken. It being understood that several traction enhancement units 16 have been excluded for illustrative purposes. It further being understood that adjustment shaft 26 would be used to vary the height of assembly support plate 34, and therefore the cutting head assembly, relative to the surface of the road under treatment. It being further understood that contact surface 14 could be constructed of many different materials and configurations, with the requirement being to ensure adequate traction to prevent slippage during use. Additionally it is understood, that while a round wheel with the supporting shaft offset from its actual center is illustrated, that oval or elongated wheels are envisioned and disclosed. Further that while a single eccentric wheel is illustrated that the use of a plurality of such wheel, linked together to ensure synchronized turning, is envisioned and disclosed.

FIGS. 5 through 9 are side plan views of a simplified illustration of the process involved with the cutting of depressions utilizing the invention. It being understood that the cutting drum illustrated, while showing an end view, would have sufficient length to perform the various depression cuts, depending upon the specifications of the individual project. Further that while the cutting head is relatively centered between the support wheel and the eccentric wheel, wide variation is possible. Additionally support wheel 146 is outside of the path of cut depressions 150 and therefore will remain in even contact with asphalt 136.

Figure 5:
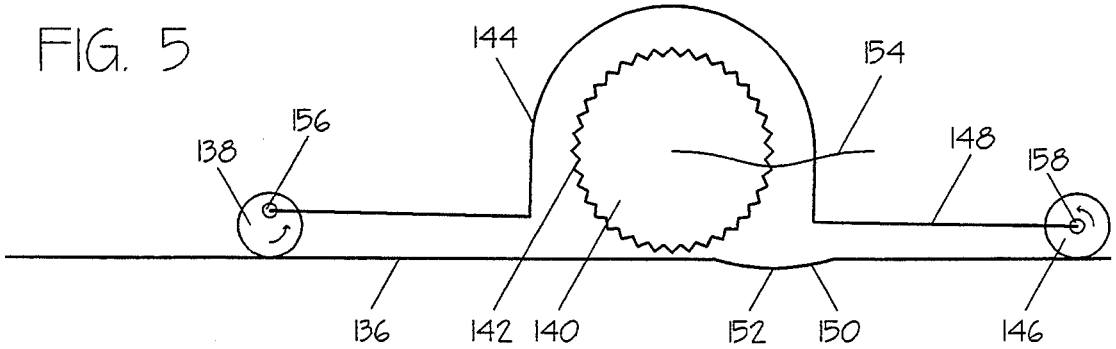
FIGS. 5 through 9 are progressive view of the cutting of a depression.

FIG. 5 is a side plan view showing a cutting head platform 148 having a drum housing 144, a cutting drum 140, of the rotation type, with a plurality of cutting teeth 142. During use cutting drum 140 is rotating utilizing hydraulic, belt or chain drive, as previously disclosed. It being noted that it is preferable to have cutting drum 140 rotating in the opposing direction of rotation of eccentric wheel 138 and support wheel 146, as this method does not allow the cutting head to pull the machine along the desired path. Attached to cutting head platform 148 is a wheel axle 158 having a support wheel 146 attached thereto. Attached to the opposing end of cutting head platform 148 is an eccentric wheel axle 156 with an eccentric wheel 138 attached thereto. It will be noted that reference is given to the direction of turn of support wheel 146 and eccentric wheel 138. It being understood that cutting head platform 148 is connected to eccentric wheel axle 156 and wheel axle 158. The above identified device rest on asphalt 136 having a previously installed cut depression 150 having a center of depression 152. It being understood the device disclosed is traveling on asphalt 136 in a right to left direction and that the center of cutting drum 140 is being tracked by an imaginary line referred to as track of drum center 154. Track of drum center 154 will vary vertically depending upon the position of eccentric wheel axle 156 relative to asphalt 136 as the entire assembly travels horizontally. It being noted that eccentric wheel axle 156 is at its vertical peak and that cutting head 140 is at its further distance possible from asphalt 136.

Figure 6:
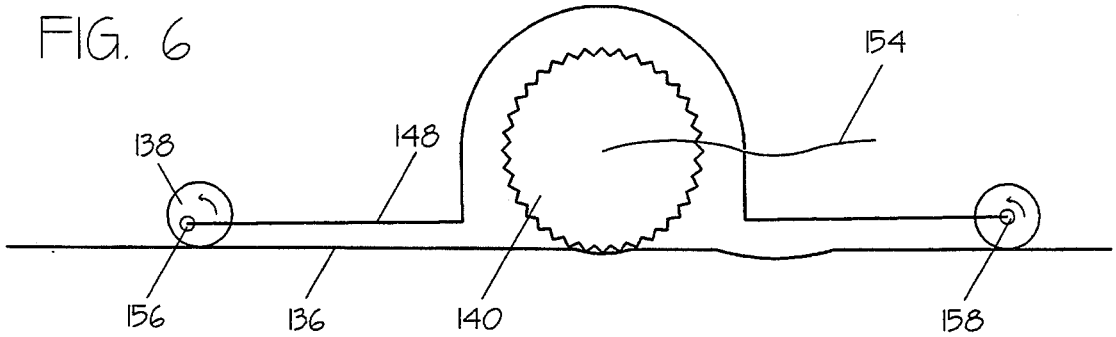

FIG. 6 is a side plan view of a progressive movement of the device disclose above. It will be noted that eccentric wheel 138 has rolled relative to asphalt 136 and that eccentric wheel axle 156 is now closer to asphalt 136 than was illustrated for FIG. 5. It will further be noted that wheel axle 158 has remained at a stationary height relative to asphalt 136. Due to this stationary pivot point, and the lowering of the front of cutting head platform 148, cutting head 140 is now in contact with asphalt 136 and cutting has commenced. It is noted that track of drum center 154 now includes the relative travel illustrated from FIG. 5 to FIG. 6.

Figure 7:
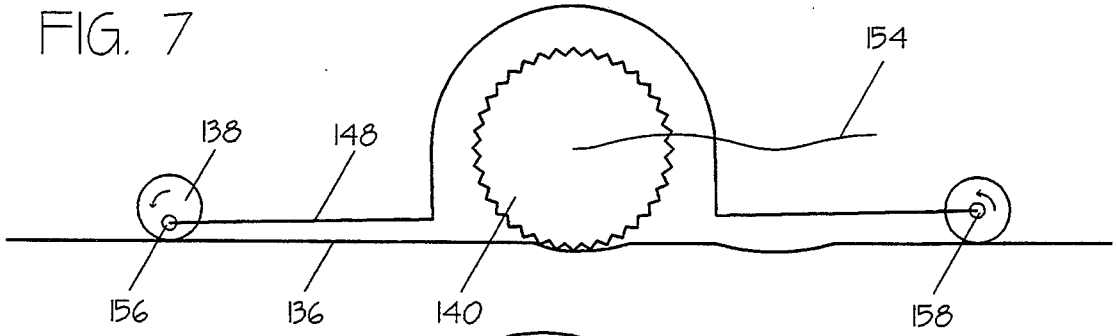

FIG. 7 is a side plan view of a progressive movement of the device disclosed for FIGS. 5 and 6. Again it will be noted that eccentric wheel 138 has rolled relative to asphalt 136 and that now eccentric wheel axle 156 is at its closes approach to asphalt 136. Wheel axle 158, while advancing horizontally, remains at a stationary height relative to asphalt 136. The pivoting of cutting head platform 148 causes cutting head 140 to continue its cutting of asphalt 136. It is noted that track of drum center 154 now includes the relative travel illustrated from FIG. 6 to FIG. 7.

Figure 8:
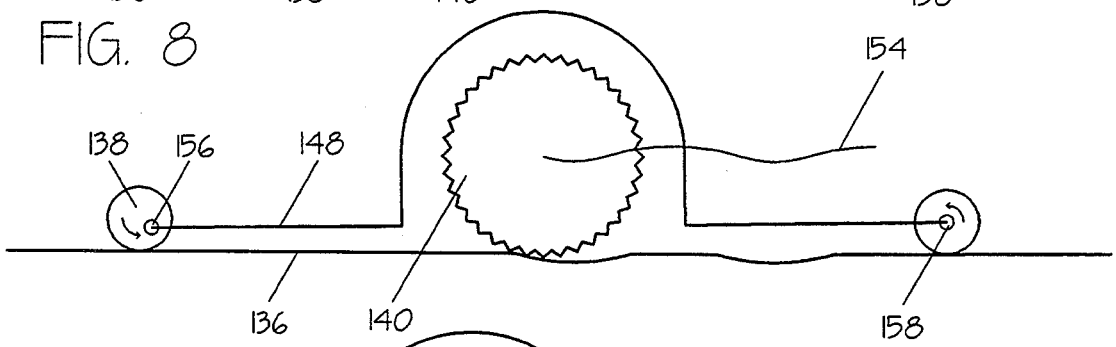

FIG. 8 is a side plan view of a progressive movement of the device disclosed for FIGS. 5, 6 and 7. It is noted that eccentric wheel 138 has rolled relative to asphalt 136 and that now eccentric wheel axle 156 is on a progressive upswing relative to asphalt 136. It will be noted that while cutting head 140 is still in contact with asphalt 136, that the depth of the cut is decreasing as cutting head platform 148 pivots upward relative to asphalt 136. Wheel axle 158, while advancing horizontally, remains at a stationary height relative to asphalt 136. It is noted that track of drum center 154 now includes the relative travel illustrated from FIG. 7 to FIG. 8.

Figure 9:
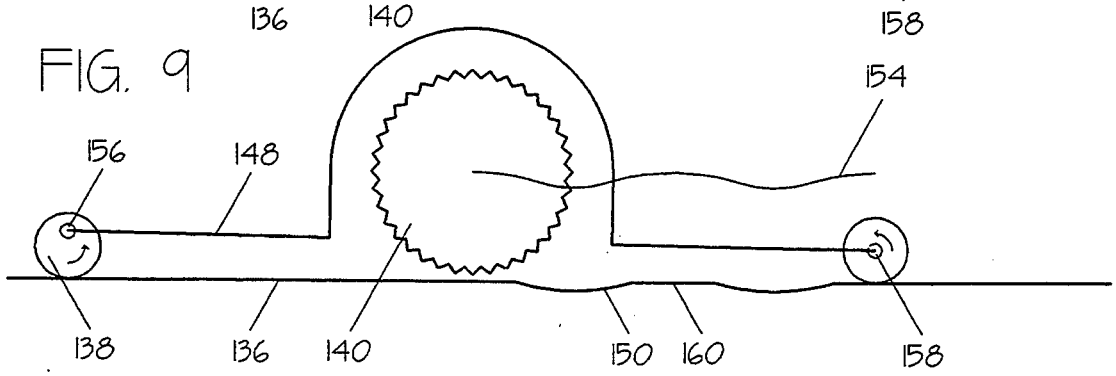

FIG. 9 is a side plan view of a progressive movement of the device disclosed for FIGS. 5, 6, 7 and 8. It will be noted that eccentric wheel 138 has continued to roll relative to asphalt 136 and that eccentric wheel axle 156 is once again at its greatest height relative to asphalt 136. It will further be noted that this is the same relative vertical position disclosed for FIG. 5 above. At this time cutting head platform 148 has pivoted upward relative to asphalt 136 and that cutting head 140 has disengaged from asphalt 136. It will be noted that wheel axle 158, while progressing horizontally, has remained at a relatively stationary vertical height to asphalt 136. It is noted that track of drum center 154 now includes the relative travel illustrated from FIG. 8 to FIG. 9. It will be noted that a second cut depression 150 has been created by the actions disclosed in FIGS. 5 through 9. A separating strip 160 is left between cut depressions 150 due to the horizontal travel of the device while cutting head 140 was not in contact with asphalt 136. It being understood that the width of separating strip 160 can be adjusted to meet the desired specifications for the particular project under construction.

CONCLUSIONS AND RAMIFICATION OF THE INVENTION

While a single eccentric wheel assembly has been disclosed, the use of a plurality of eccentric wheel assemblies, each either having a relatively long wheel, or a plurality of shorter length wheel members, is envisioned. The most likely use of a plurality of matching eccentric wheel assembles, each utilizing the disclosed offset means, has them placed on opposing ends of the cutting head assembly. Here they would be linked, by any of several methods known in the art, so as to rotate relative to one another in a synchronized manner. Rather than pivoting the front of the cutting head up, as disclosed, this arrangement would lift and lower the entire cutting head while it remained relatively level to the road surface.

An eccentric wheel assembly, having a substantially long wheel member has been disclosed, which is provided to accommodate the weight of the cutting head assembly, and the resulting requirement of distributing this weight over a relatively large area. This is envisioned as the most practical configuration available, as it has advantages in the placement and cutting characteristics which tend to average the surface and provides for better placement than would a shorter length wheel member. But the use of a single, shorter length wheel, or a plurality of shorter length wheels is envisioned, and disclosed.

While the use of a single drum type cutting head has been disclosed, the use of a plurality of drum type cutting heads is envisioned and disclosed. The use of such a configuration would be much more complicated than the relatively simple design allowed for with the use of a single cutting head. It is possible that such a use would permit faster machines to be designed and there design is envisioned and disclosed.

Similarly it is envisioned that spaced cutting heads could be used alongside one another. This sort of configuration has merit in that the cutting heads could be revolving in opposing directions and offset the pushing effect of the cutting operation. The most likely use of this configuration would be cutting adjacent series of depressions centered on the dividing, or center line, of a road. The removal of the center group of teeth from the cutting head assembly disclosed would facilitate a similar pattern being produced.

While only one embodiment of the invention have been described, it will be understood that it is capable of still further modifications, and this application is intended to cover any variation, uses, or adaptations of the invention, following in general the principles of the invention and including such departures from the present disclosure as to come with the knowledge of customary practice in the art to which this invention pertains, and as may be applied to the essential features hereinbefore set forth and falling within the scope of the invention or the limits of the appended claims.

I claim:

1. A machine for continuous cutting of depressions in an asphalt road surface mounted to a self propelled vehicle comprising;

a) at least one cutting head, said cutting head having a plurality of teeth, a predetermined diameter, and a predetermined length, b) rotation generation means to facilitate rotation of said cutting head, c) alignment means to align said cutting head to said asphalt road surface, d) drive means to propel said self propelled vehicle, e) control means to manage said drive means, f) at least one wheel, said wheel in contact with said surface of said asphalt road and rotating in a synchronized manner to said surface, g) at least one shaft, said shaft to partially support said cutting head, h) offset means to install said shaft eccentrically in said wheel, i) a pivot point, said pivot point on opposing side of said cutting head from said wheel, wherein said pivot point cooperates with said at least one wheel for partially supporting cutting head, whereby the machine would move along the desired path of the series of cuts and the wheel with the off center shaft would cause the cutting head to pivot down and into contact with the surface and up and out of contact with the surface causing a series of cuts to be made.

2. The invention defined in claim 1 wherein said cut depressions each measure approximately seven inches across, approximately sixteen inches long, approximately one half inch deep with a spacing between adjacent depressions of approximately five inches.

3. The invention defined in claim 1 wherein said alignment means include adjustment means to align the cutting head for evenness of cut.

4. The invention defined in claim 1 further comprising traction enhancement means, said traction enchantment means comprising attachment of synthetic material to said wheel whereby possible slippage of the wheel during use is reduced.

5. The invention defined in claim 1 wherein said machine for continuous cutting of depressions is constructed so as to be a part of said self propelled vehicle.

6. The invention defined in claim 1 wherein said machine for continuous cutting of depressions is detachably attached to said self propelled vehicle.

7. The invention defined in claim 1 further comprising path clearing means, said path clearing means to reposition debris away from path of said pivot point whereby the apparatus comprising the pivot point is capable of tracking the true surface of the road under treatment.

8. The method of cutting a series of depressions in a continuous manner in a road surface comprising the steps of;

a) providing a self propelled vehicle, b) providing a cutting tool comprising at least one cutting head, said cutting head having rotation means, said cutting head attached to said self propelled vehicle, c) propelling said cutting head along a desired path of said series of depressions utilizing said self propelled vehicle, providing cam means on supporting wheel means for uniformly transferring raising and lowering movements to said cutting head, thereby causing the uniformity of the spacing of the individual cuts within said series of the said depressions, e) providing engagement means, to permit said cutting head to contact said road surface during said lowering by said cam means, f) providing disengagement means, to permit said cutting head to withdraw from contact with said road surface during said raising by said cam means, whereby a self propelled vehicle would travel along a desired path in a continuous and nonstop manner and the uniform movements, being generated, and synchronized with, the passing of the road surface, would cause the cutting head to move down, and into contact, and up, and out of contact, with the road surface in a repetitive series to form the desired series of cuts.

9. The invention defined in claim 8 wherein said cam means further comprises, distance adjustment means, said distance adjustment means to allow adjustment of said cam means to match rotation of said cam means to a distance of travel on said road surface, whereby one cycle of raising and lowering of the cutting head can be matched to a desired length of travel of the machine over the surface of the road under treatment.

10. The invention defined in claim 8 wherein said cam means further comprises, offset adjustment means whereby the lift of the cutting head can be matched to a desired depth of cut of the depressions.

11. The invention defined in claim 8 wherein said series of cut depressions each measure approximately seven inches across, approximately sixteen inches long, approximately one half inch deep with a spacing between adjacent depressions of approximately five inches.

12. The invention defined in claim 8 further comprising alignment means, said alignment means to align said cutting head to said road surface for evenness of cut.

13. The invention defined in claim 8 further comprising traction enhancement means, said traction enhancement means comprising attachment of synthetic material to said wheel means, thereby preventing slippage of the cutting tool.

14. The invention defined in claim 8 wherein said cutting tool is constructed so as to be a part of said self propelled vehicle.

15. The invention defined in claim 8 wherein said cutting tool is detachably attached to said self propelled vehicle.

* * * * *